US011794500B2

(12) United States Patent
Jung et al.

(10) Patent No.: US 11,794,500 B2
(45) Date of Patent: Oct. 24, 2023

(54) THERMAL TRANSFER DEVICE WITH COMMUNICATION FUNCTION AND MANAGING SYSTEM THEREOF

(71) Applicant: KYUNGIL-TECH CO., LTD., Gyeongsangnam-do (KR)

(72) Inventors: Soon Tae Jung, Gyeongsangnam-do (KR); Sang Min Lee, Gyeongsangnam-do (KR); Hye Jin Lee, Gyeongsangnam-do (KR)

(73) Assignee: Kyungil-Tech Co., Ltd., Gyeongsangnam-do (KR)

( * ) Notice: Subject to any disclaimer, the term of this patent is extended or adjusted under 35 U.S.C. 154(b) by 658 days.

(21) Appl. No.: 17/040,115

(22) PCT Filed: Aug. 13, 2020

(86) PCT No.: PCT/KR2020/010805
§ 371 (c)(1),
(2) Date: Sep. 22, 2020

(87) PCT Pub. No.: WO2021/040294
PCT Pub. Date: Mar. 4, 2021

(65) Prior Publication Data

US 2023/0033462 A1 Feb. 2, 2023

(30) Foreign Application Priority Data

Aug. 23, 2019 (KR) ..... 10-2019-0103665
Aug. 23, 2019 (KR) ..... 10-2019-0103666

(51) Int. Cl.
*B41J 29/38* (2006.01)
*B41F 16/02* (2006.01)
(Continued)

(52) U.S. Cl.
CPC ..... *B41J 29/38* (2013.01); *B41F 16/02* (2013.01); *B41F 33/00* (2013.01); *G06Q 50/10* (2013.01)

(58) Field of Classification Search
CPC .. B41J 29/38; B41J 2/325; B41J 2/355; B41F 16/02; B41F 33/00; B41F 16/006;
(Continued)

(56) References Cited

U.S. PATENT DOCUMENTS

2008/0126870 A1* 5/2008 Odani ..... G03G 15/5079 714/37

FOREIGN PATENT DOCUMENTS

JP 2003-186649 A 7/2003
JP 2008-015568 A 1/2008

OTHER PUBLICATIONS

Office Action dated Sep. 25, 2020 in corresponding Korean Patent Application No. 10-2019-0103665.
(Continued)

*Primary Examiner* — Bradley W Thies
(74) *Attorney, Agent, or Firm* — Fox Rothschild LLP

(57) ABSTRACT

A thermal transfer device with a communication function and a management system thereof can transfer state information and/or failure information of the thermal transfer device via the communication function, manage the received state information and failure information, and provide them to a user. The thermal transfer device includes a driving unit provided with at least one motor to perform a conveying or blowing function under the control of a control unit, a heating unit provided with at least one heater to perform a heating operation under the control of the control unit, a communication unit for accessing the network, and the control unit for controlling the driving unit and the heating unit to perform a thermal transfer function and transferring
(Continued)

state information related to the operation of the thermal transfer device to a management server through the communication unit.

13 Claims, 2 Drawing Sheets

(51) Int. Cl.
*B41F 33/00* (2006.01)
*G06Q 50/10* (2012.01)

(58) Field of Classification Search
CPC .. B41F 16/0006; B41F 33/0009; B41F 33/02; G06Q 50/10
See application file for complete search history.

(56) References Cited

OTHER PUBLICATIONS

Office Action dated Sep. 25, 2020 in corresponding Korean Patent Application No. 10-2019-0103666.

* cited by examiner

THERMAL TRANSFER DEVICE WITH COMMUNICATION FUNCTION AND MANAGING SYSTEM THEREOF

TECHNICAL FIELD

The present invention relates to a thermal transfer device, and more particularly, to a thermal transfer device with a communication function and a management system thereof which can transfer state information and/or failure information of the thermal transfer device via the communication function, manage the received state information and failure information, and provide them to a user.

BACKGROUND ART

In general, a variety of patterns are printed on textiles such as handkerchiefs or cloths mainly by a transfer printing method, in which transfer paper coated with specific patterns, pictures or the like is placed on a fabric (fiber) to be printed, and then the transfer paper and the fabric (fiber) are pressed with a heating roller heated to an appropriate temperature, moving it in one direction, such that the patterns on the transfer paper are transferred to the fabric (fiber).

The thermal transfer device is roughly classified as a roll type and a piece type, in which the roll type automatically and continuously supplies the fabric and transfer paper, while the piece type automatically supplies the transfer paper but supplies each sheet of fabric.

When the conventional thermal transfer device is located remotely, there is no way of checking its operating state or failure state.

In addition, when the manufacturer or supplier of the thermal transfer device or the parts thereof is located distant from the thermal transfer device, it is difficult to check a part replacement time of each thermal transfer device in person, which makes it difficult to replace the parts in an appropriate time, when considering a manufacturing period and a delivery period of each part.

DISCLOSURE OF THE INVENTION

An object of the present invention is to provide a thermal transfer device with a communication function and a management system thereof which can transfer state information and/or failure information of the thermal transfer device and manage the received state information and failure information, such that a user can check the state of the thermal transfer device even at a long distance.

Another object of the present invention is to provide a thermal transfer device with a communication function and a management system thereof which can transfer a guide (alert or alarm) message for part replacement of each thermal transfer device, using a working time and a part service life of the thermal transfer device.

According to an aspect of the present invention for achieving the above objects, there is provided a thermal transfer device with a communication function, comprising a driving unit provided with at least one motor to perform a conveying or blowing function under the control of a control unit, a heating unit provided with at least one heater to perform a heating operation under the control of the control unit, a communication unit for accessing the network, and the control unit for controlling the driving unit and the heating unit to perform a thermal transfer function and transferring state information related to the operation of the thermal transfer device to a management server through the communication unit.

In some embodiments, preferably, the state information may include at least one of the sensed values of a rotation speed of the driving unit, electrical properties, voltage, temperature, and vibration.

In some embodiments, preferably, the thermal transfer device may comprise a sensing unit for sensing the sensed values included in the state information and transferring the sensed values to the control unit.

In some embodiments, preferably, the control unit may store reference failure information, compare the sensed values with the reference failure information to generate failure information, and transfer the failure information to the management server through the communication unit.

In some embodiments, preferably, the state information may include a working time of the thermal transfer device.

In some embodiments, preferably, the control unit may calculate the working time of the thermal transfer device and add the working time to the state information.

According to another aspect of the present invention for achieving the above objects, there is provided a management system of a thermal transfer device, comprising the thermal transfer device, and a management server for accessing the communication unit of the thermal transfer device through the network, receiving and storing state information and failure information.

In some embodiments, preferably, the management system may comprise a user terminal for accessing the management server through the network, the management server may transfer the state information corresponding to the accessed user terminal to the user terminal and the user terminal may receive and display the state information, and the management server may transfer the failure information to the user terminal corresponding to the stored failure information and the user terminal may receive and display the failure information.

In some embodiments, preferably, the management server may calculate the remaining time of the thermal transfer device, based on the working time included in the stored state information and the prestored part service life, and transfer a guide message for part replacement to the user terminal when the remaining time is within a reference time.

In some embodiments, preferably, the management server may calculate the remaining time of each part, based on the service life and working time of each part, and transfer a guide message for each part replacement to the user terminal, based on the remaining time of each part.

According to a further aspect of the present invention for achieving the above objects, there is provided a management method of a thermal transfer device, comprising receiving state information and failure information from the thermal transfer device, and transferring the received state information and failure information to a user terminal corresponding to the state information and failure information.

In some embodiments, preferably, the management method may comprise calculating the remaining time of the thermal transfer device, based on the working time included in the state information and the prestored part service life, and transferring a guide message for part replacement to the user terminal when the remaining time is within the reference time.

In some embodiments, preferably, the management method may comprise calculating the remaining time of each part, based on the service life and working time of each part, and transferring a guide message for each part replacement to the user terminal, based on the remaining time of each part.

According to the present invention, the thermal transfer device with the communication function and the management system thereof can transfer state information and/or failure information of the thermal transfer device via the communication function and manage the received state information and failure information, as a result of which the user can check the current state and failure of the thermal transfer device even at a long distance, which leads to improved efficiency of managing the thermal transfer device.

According to the present invention, the thermal transfer device with the communication function and the management system thereof can alert or alarm the user to part replacement of each thermal transfer device, using the working time and the part service life of the thermal transfer device, as a result of which the user or manufacturer can replace the parts in consideration of a manufacturing period and a delivery period of the parts, which leads to the continuous use of the thermal transfer device.

BEST MODE FOR CARRYING OUT THE INVENTION

Figure 1:
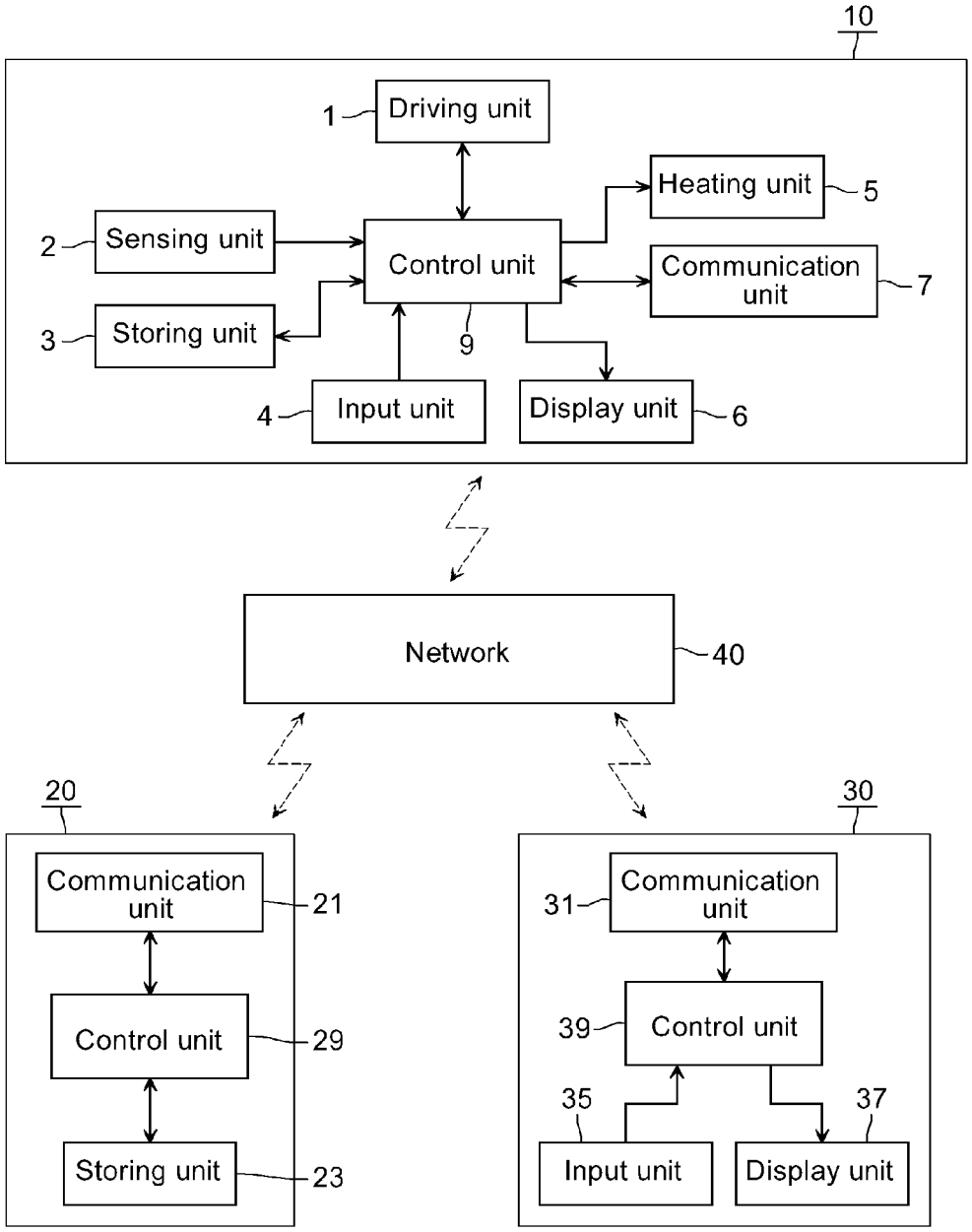
FIG. 1 is a schematic block diagram of a thermal transfer device with a communication function and a management system thereof according to the present invention.

Hereinafter, example embodiments of a thermal transfer device with a communication function and a management system thereof according to the present invention will be described in detail with reference to the accompanying drawings. However, it should be understood that there is no intent to limit the example embodiments to the particular forms disclosed, but on the contrary, the example embodiments are to cover all modifications, equivalents, and/or alternatives falling within the scope of the invention. Like numbers refer to like elements throughout the description of the drawings.

As used herein, the expressions "have", "can have", "include", or "can include" designate the existence of the corresponding features (e.g., numerical values, functions, operations, or components such as parts), but do not exclude the existence of other features.

As used herein, the expressions "A or B", "at least one of A and/or B", or "one or more of A and/or B" may include all possible combinations of the listed items. For example, "A or B", "at least one of A and B", or "at least one of A or B" may designate (1) at least one A, (2) at least one B, or (3) at least one A and at least one B.

As used herein, the expressions "first", "second", "primary", or "secondary" may modify a variety of elements, regardless of the order and/or the importance, and may solely distinguish one element from another without restricting the corresponding elements. For example, a first user device and a second user device may designate different user devices, regardless of the order and/or the importance. For example, a first user device may be referred to as a second user device, and vice versa.

When an element (e.g., a first element) is referred to as being "operatively or communicatively coupled to" or "operatively or communicatively connected to" the other element (e.g., a second element), it should be understood that the element may be directly coupled to the other element or an intervening element (e.g., a third element) may be present. In contrast, when an element (e.g., a first element) is referred to as being "directly coupled to" or "directly connected to" the other element(e.g., a second element), it should be understood that there may be no intervening element (e.g., a third element) between them.

As used herein, the expression "configured to (or set to)" may be interchangeably used with, for example, "suitable for", "having the capacity to", "designed to", "adapted to", "made to", or "capable of", depending on the context. The expression "configured to (or set to)" may not necessarily imply "specifically designed to" in terms of hardware. Rather, depending on the context, the expression "configured to (or set to)" may imply that a device is "capable of performing an operation" with another device or component. For instance, the phrase "a processor configured to (or set to) perform A, B and C" may represent a dedicated processor (e.g., an embedded processor) for performing the corresponding operation, or a generic purpose processor (e.g., a CPU or application processor) capable of performing the corresponding operation by executing one or more software programs stored in a memory.

The terms used herein are for illustrative purposes only of specific embodiments and are not intended to limit the scope of the present invention. The singular forms may include the plural forms as well, unless the context clearly indicates otherwise. All technical and scientific terms used herein have the same meaning as commonly understood by one of ordinary skill in the art to which the present invention belongs. The terms defined in commonly used dictionaries should be interpreted as having a meaning that is consistent with their meaning in the context of the relevant art and will not be interpreted in an idealized or overly formal sense, unless expressly so defined herein. In some cases, even the terms defined herein cannot be construed as excluding the example embodiments of the present invention.

FIG. 1 is a schematic block diagram of a thermal transfer device with a communication function and a management system thereof according to the present invention.

A monitoring system comprises a thermal transfer device 10 for transferring its state information and/or failure information to a management server 20 via a communication function at preset time intervals (e.g., in every one minute), the management server 20 for receiving the state information and failure information from at least one thermal transfer device 10, storing them to correspond to each thermal transfer device 10, and transferring the state information and failure information or a guide (alarm or alert) message for part replacement to a user terminal 30 when accessing the management server 20, the user terminal 30 for accessing the management server 20, receiving and displaying the state information and failure information or the guide message for part replacement of the thermal transfer device 10 owned or sold by a user, and a network 40 for allowing for wired communication and/or wireless communication between the thermal transfer device 10 and the management server 20 and the user terminal 30.

First, the mechanical construction of the thermal transfer device 10, such as a transfer paper feeding unit, a transfer paper winding unit, a thermal transfer unit and a cooling fan, are easily recognized by one of ordinary skill in the art, so a detailed description thereof is omitted. Only a control mechanism will be described in this specification.

The thermal transfer device 10 comprises a driving unit 1 provided with at least one motor, inverter or the like to perform a conveying or cooling (or blowing) function under the control of a control unit 9, a sensing unit 2 for sensing at least one of a rotation speed of the motor, electrical properties of the thermal transfer device such as voltage and/or current, pressure, temperature and vibration and periodically transferring the sensed values to the control unit 9, a storing unit 3 for storing the sensed values from the sensing unit 2, a control algorithm for thermal transfer, reference failure information for determination of failure, state information and failure information, and access information to the management server 20, an input unit 4 for acquiring an input for the thermal transfer device from the user (e.g., application of power, operation start/operation stop, enabling of an emergency switch, etc.) and transferring it to the control unit 9, a heating unit 5 provided with at least one heater to perform a heating operation under the control of the control unit 9, a display unit 6 for displaying the operating state and power state of the thermal transfer device 10, a communication unit 7 for accessing the network 40 and transferring the state information and failure information under the control of the control unit 9, and the control unit 9 for controlling the aforementioned components and mechanical constructions thereof to perform a thermal transfer function, generate state information and failure information and transfer them to the management server 20 through the communication unit 7, or to calculate a working time of the thermal transfer device 10, store the working time in the storing unit 3, and transfer state information including the working time and/or the sensed values to the management server 20 through the communication unit 7. Here, a power supply (not shown) for supplying required power, driving unit 1, sensing unit 2, input unit 4, heating unit 5 and display unit 6 are easily recognized by one of ordinary skill in the art, so a detailed description thereof is omitted.

First, the storing unit 3 is, for example, a storage medium such as a memory, that stores the sensed values from the sensing unit 2, the control algorithm for thermal transfer, reference failure information for determination of failure, state information and failure information, and access information. The sensed values are those transferred from the sensing unit 2, as described above, and the control algorithm for thermal transfer is easily recognized by one of ordinary skill in the art, so a detailed description thereof is omitted.

The reference failure information includes reference values (e.g., a reference rotational speed, reference temperature, reference pressure, reference electrical property, reference vibration, etc.) to be compared with the sensed values to determine the occurrence of failure.

The state information includes at least one of the aforementioned sensed values and the current operating state of the thermal transfer device 10 and is generated by the control unit 9. In addition, the state information may include only the working time of the thermal transfer device 10 (or the operating time of the driving unit 1) calculated by the control unit 9 or may further include the working time.

For the failure information, the control unit 9 compares the stored sensed values with the corresponding reference values, respectively, to determine the occurrence of failure, generates failure information including a failure code corresponding to the occurrence of failure or a failure code corresponding to access failure to the driving unit 1 (e.g., disconnection), and stores it in the storing unit 3.

The access information to the management server 20 allows the communication unit 7 to communicate with the management server 20 through the network 40 and includes, for example, an IP address of the management server 20 and an identification number of the thermal transfer device 10 (e.g., a model number, serial number, etc.).

The communication unit 7 represents a communication device for communicating with the management server 20 through the network 40.

The control unit 9 performs the thermal transfer function according to the user input from the input unit 4 and the control algorithm for thermal transfer. In addition, the control unit 9 generates the state information including the sensed values and the current operating state and stores it in the storing unit 3. Further, the control unit 9 calculates the working time of the thermal transfer device 10 using a built-in timer, when performing the thermal transfer function according to the control algorithm for thermal transfer, and stores it in the storing unit 3. Furthermore, the control unit 9 generates the failure information including the sensed values and the failure code corresponding to the occurrence of failure or the failure code corresponding to access failure, based on the reference failure information, and stores it in the storing unit 3.

The management server 20 comprises a communication unit 21 for communicating with the thermal transfer device 10 and the user terminal 30 through the network 40, a storing unit 23 for storing information on the thermal transfer device 10 and information on the user or user terminal 30, and a control unit 23 for receiving the information on the thermal transfer device 10 and the information on the user (or seller) or user terminal 30 from the communication unit 21, storing them in the storing unit 23, and transferring the state information and failure information or the guide (alarm or alert) message for part replacement to the user terminal 30 through the communication unit 21. The management server 20 also includes other components, but only those related to the present invention will be described. Here, a power supply (not shown) and communication unit 21 are easily recognized by one of ordinary skill in the art, so a detailed description thereof is omitted.

The storing unit 23 stores the information on the thermal transfer device 10, which includes at least a preset service life of each part (hereinafter, referred to as a part service life). The part service life represents a preset service life of each part in each model of the thermal transfer device 10.

The user terminal 30 represents an electric device (e.g., a computer, smartphone, etc.) for allowing the user or intermediate seller of the thermal transfer device 10 to check the state or failure of the thermal transfer device 10. The user terminal 30 comprises a communication unit 31 for communicating with the management server 20 through the network 40, an input unit 35 for acquiring an input from the user (e.g., information on the thermal transfer device 10, information on the user or user terminal 30, login information, etc.) and transferring it to a control unit 39, a display unit 37 for visually and/or audibly displaying the state information and failure information from the control unit 39, and the control unit 39 for controlling the aforementioned components to perform a process for registration and a process of requesting and receiving the state information and failure information from the management server 20, using the input from the input unit 35. The user terminal 30 also includes other components, but only those related to the present invention will be described. Here, a power supply (not shown), communication unit 31, input unit 35 and display unit 37 are easily recognized by one of ordinary skill in the art, so a detailed description thereof is omitted.

First, a process of the user or intermediate seller registering the thermal transfer device 10 in the management server 20 through the user terminal 30 will now be described.

The control unit 39 accesses the management server 20 through the communication unit 31 to perform a membership and login procedure. In the membership procedure, the control unit 29 may acquire an identification number of the user (owner, intermediate seller) and information on the thermal transfer device 10 (e.g., an identification number, model number, serial number, etc.) and store them in the storing unit 23, or after the login procedure, the control unit 29 may further acquire and store them in the storing unit 23.

The control unit 29 allows the registration procedure of the information on the thermal transfer device 10 (e.g., identification number, etc.) through the user terminal 30 to be carried out and stores the identification number or the like of at least one thermal transfer device 10 in the storing unit 23 to correspond to the user (or user identification number). That is, the control unit 29 stores thermal transfer device data of each user in the storing unit 23. In addition to the thermal transfer device data of each user, the control unit 29 may store the part service life, which is also the information on the thermal transfer device 10, individually or in relation to or in correspondence with the model of the thermal transfer device included in the thermal transfer device data of each user.

In addition to the aforementioned method, the control unit 29 can acquire the information on the thermal transfer device 10 and the information on the user terminal 30 by a number of possible methods and store them in the storing unit 23.

Then, a process of the management server 20 receiving the state information and failure information from the thermal transfer device 10, storing and transferring them to the user terminal 30 will now be described.

The control unit 9 periodically acquires the access condition or state information from the driving unit 1, the sensing unit 2 or the like, generates the state information and failure information, and stores them in the storing unit 3. In addition, the control unit 9 controls the communication unit 7 to maintain communication accessibility to the communication unit 21 of the management server 20, reads the state information and failure information from the storing unit 3, and transfers the monitoring data including the identification number of the thermal transfer device 10 and the state information and failure information to the management server 20 through the communication unit 7 at reference time intervals (e.g., 10 seconds or 2 seconds). The control unit 29 receives the monitoring data through the communication unit 21, adds it to the thermal transfer device data of each user that corresponds to the identification number of the thermal transfer device 10 included in the monitoring data, and stores them together. More specifically, the control unit 29 adds the date of receiving the monitoring data (year, month, day, hour, minute, second) to the thermal transfer device data of each user and stores them together.

Then, a process of the user terminal 30 receiving and providing state information to the user will now be described.

The control unit 39 controls the communication unit 31 to maintain communication accessibility to the management server 20, generates a request data for requesting state information on the thermal transfer device 10 corresponding to the user or user terminal 30 (e.g., the identification number of the user or user terminal 30, the identification number of the thermal transfer device 10, etc.) from the management server 20, and transfers it to the management server 20. The control unit 29 receives the request data through the communication unit 21, retrieves the user or thermal transfer device 10 corresponding to the request data from the thermal transfer device data of each user stored in the storing unit 23, reads the latest state information included in the thermal transfer device data of each user, generates a response data including the state information, and transfers it to the user terminal 30. The control unit 39 visually and/or audibly displays the state information included in the response data through the display unit 37, such that the user can check the state of the thermal transfer device 10 anytime.

Then, a process of the user terminal 30 receiving and providing failure information to the user will now be described.

As described above, the control unit 29 receives failure information from the thermal transfer device 10, adds it to the thermal transfer device data of each user, and stores them together in the storing unit 23, in which the control unit 29 transfers the failure information to the user terminal 30 corresponding to the thermal transfer device data of each user through the communication unit 21. Here, the management server 20 and the user terminal 30 corresponding to the failure information have communication accessibility to each other. The control unit 39 receives the failure information through the communication unit 31 and visually and/or audibly displays the failure information through the display unit 37, such that the user can check the failure information and deal with the problem immediately (such as by corrective maintenance).

Then, a process of the management server 20 receiving state information from the thermal transfer device 10, storing and providing it to the user terminal 30 will now be described.

The control unit 9 periodically acquires the sensed values from the driving unit 1, the sensing unit 2 or the like, adds them to the state information, and stores them together in the storing unit 3. In addition, the control unit 9 calculates the working time of the thermal transfer device 10, adds it to the state information, and stores them together in the storing unit 3. Further, the control unit 9 controls the communication unit 7 to maintain communication accessibility to the communication unit 21 of the management server 20, reads the state information from the storing unit 3, and transfers the monitoring data including the identification number of the thermal transfer device 10 and the state information to the management server 20 through the communication unit 7 at reference time intervals (e.g., 10 seconds or 2 seconds). The control unit 29 receives the monitoring data through the communication unit 21 at reference time intervals, adds it to the thermal transfer device data of each user that corresponds to the identification number of the thermal transfer device 10 included in the monitoring data, and stores them together. More specifically, the control unit 29 adds the date of receiving the monitoring data (year, month, day, hour, minute, second) to the thermal transfer device data of each user and stores them together.

Figure 2:
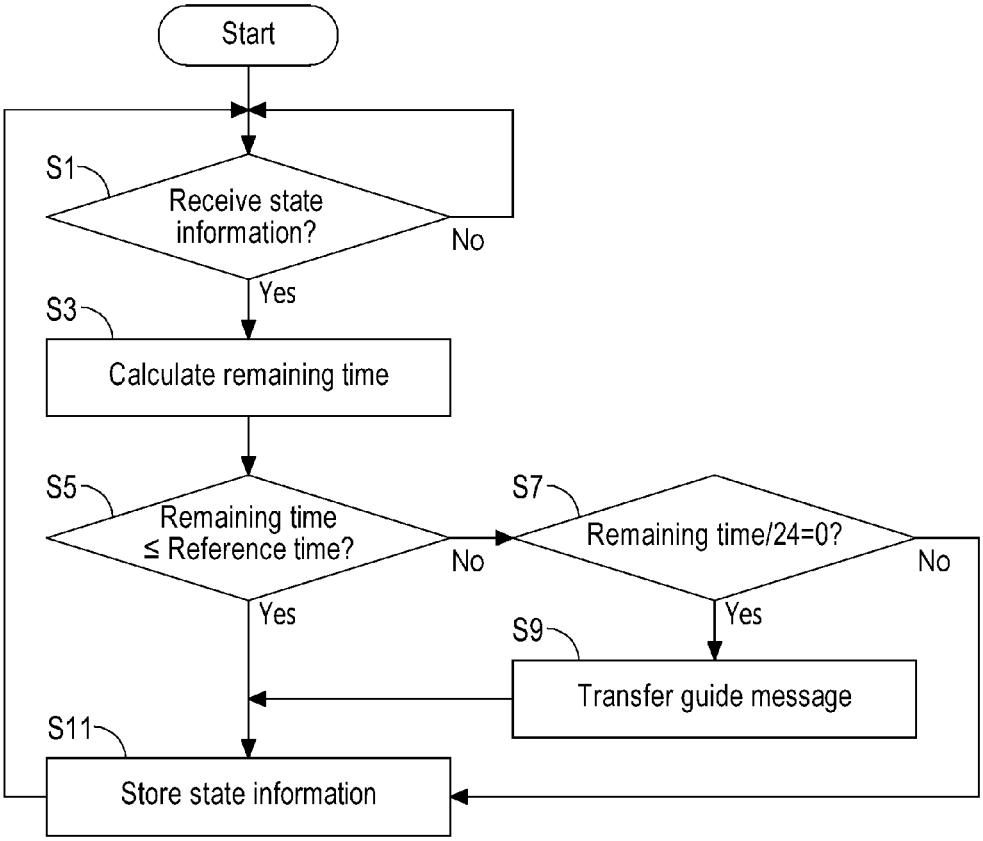
FIG. 2 is a flowchart of an alert function for a part replacement time by a management server of FIG. 1.

FIG. 2 is a flowchart of an alert function for a part replacement time by the management server of FIG. 1.

The management server 20 and the thermal transfer device 10 have communication accessibility to each other.

In step S1, the control unit 29 determines whether it has received the state information from the thermal transfer device 10 through the communication unit 21. If the control unit 29 has received the state information, then it goes to step S3, and if not, then it repeatedly performs step S1 until the receipt of the state information.

In step S3, the control unit 29 calculates the remaining time using the identification number of the thermal transfer device 10 and the working time included in the received state information. Since the part service life has been stored in the storing unit 23 to correspond to the identification number (or model number) of the thermal transfer device 10, the control unit 29 calculates the remaining time by subtracting the working time from the stored part service life of the thermal transfer device 10. Here, the control unit 29 calculates the remaining time of each part using the part service life and the working time of each part of the thermal transfer device 10. The control unit 29 goes to step S5 after performing step S3.

In step S5, the control unit 29 compares the remaining time with a reference time. Here, the reference time represents a time to guide (alarm or alert) the user to part replacement, considering a manufacturing period and a delivery period of the parts, which is set to, for example, 360 hours. If the remaining time is within the reference time, then the control unit 29 goes to step S7, and if not, the control unit 29 goes to step S11.

In step S7, the control unit 29 determines whether the remainder of the remaining time divided by 24 hours is equal to 0 in order to transfer the guide message for part replacement to the user terminal 30 in every reference period (e.g., 24 hours). If the remainder is equal to 0, then the control unit 29 goes to step S9, and if not, the control unit 29 goes to step S11.

In step S9, the control unit 29 transfers the guide message for part replacement (that includes, e.g., the part name, remaining time, etc.) to the user terminal 30 through the communication unit 21, and the user terminal 30 displays the guide message for part replacement through the display unit 37. The control unit 29 goes to step S11 after performing step S9.

In step S11, the control unit 29 stores the state information received in step S1 in the storing unit 23 and goes back to step S1 to continuously alert the user to the part replacement time.

The aforementioned part service life can be differently set for each model of the thermal transfer device 10 and stored in the storing unit 23. The control unit 29 reads the part service life of step S5 from the storing unit 23, using the information on the thermal transfer device 10 corresponding to the model of the thermal transfer device 10.

In the above step S5, the reference time can be differently stored for each part of the thermal transfer device 10 in the storing unit 23, and the control unit 29 can read the reference time of each part and guide the user to each part replacement. In this case, the control unit 29 compares the remaining time of each part with the reference time of each part, respectively, and if the remaining time of each part is less than the reference time of each part, the control unit 29 goes to steps S7 and S9 to generate a guide message for each part replacement and transfer it to the user terminal 30. Therefore, the user terminal 30 can display the guide message for each part replacement of the thermal transfer device 10 through the display unit 37.

In addition, the reference time can also be differently stored for each model of the thermal transfer device 10 in the storing unit 23, and the control unit 29 can perform steps S5 to S11, using the reference period of each model and each part of the thermal transfer device 10 stored in the storing unit 23.

Further, it is possible for the reference time to be decided in consideration of a manufacturing period and a delivery period of each part or to be arbitrarily decided by the manufacturer or user. Furthermore, the reference time may represent a time corresponding to a certain percentage (e.g., 10%, 20%, etc.) of the service life of each part. Still furthermore, it is possible for the reference time to be set to the same time (e.g., 100 hours, etc.), regardless of the type of each part.

Alternatively, the control unit 29 may transfer the guide message only certain times (e.g., once, twice), if the remaining time of each part is less than the reference time in step S5, without performing step S7 of periodically transferring the guide message.

While the present invention has been illustrated and described in connection with the accompanying drawings and the preferred embodiments, the present invention is not limited thereto and is defined by the appended claims. Therefore, it will be understood by one of ordinary skill in the art that various modifications and changes can be made thereto without departing from the spirit and scope of the invention defined by the appended claims.

What is claimed is:

1. A thermal transfer device with a communication function, comprising:

a driving unit provided with at least one motor to perform a conveying or blowing function under the control of a control unit;

a heating unit provided with at least one heater to perform a heating operation under the control of the control unit;

a communication unit for accessing the network; and the control unit for controlling the driving unit and the heating unit to perform a thermal transfer function and transferring state information related to the operation of the thermal transfer device to a management server through the communication unit.

2. The thermal transfer device of claim 1, wherein the state information includes at least one of the sensed values of a rotation speed of the driving unit, electrical properties, voltage, temperature, and vibration.

3. The thermal transfer device of claim 2, wherein the thermal transfer device comprises a sensing unit for sensing the sensed values included in the state information and transferring the sensed values to the control unit.

4. The thermal transfer device of claim 2, wherein the control unit stores reference failure information, compares the sensed values with the reference failure information to generate failure information, and transfers the failure information to the management server through the communication unit.

5. The thermal transfer device of claim 1, wherein the state information includes a working time of the thermal transfer device.

6. The thermal transfer device of claim 5, wherein the control unit calculates the working time of the thermal transfer device and adds the working time to the state information.

7. A management system of a thermal transfer device, comprising:

the thermal transfer device as recited in claim 1; and a management server for accessing the communication unit of the thermal transfer device through the network, receiving and storing state information and failure information.

8. The management system of claim 7, wherein the management system comprises a user terminal for accessing the management server through the network, the management server transfers the state information corresponding to the accessed user terminal to the user terminal and the user terminal receives and displays the state information, and the management server transfers the failure information to the user terminal corresponding to the stored failure information and the user terminal receives and displays the failure information.

9. The management system of claim 7, wherein the management server calculates the remaining time of the thermal transfer device, based on the working time included in the stored state information and the prestored part service life, and transfers a guide message for part replacement to the user terminal when the remaining time is within the reference time.

10. The management system of claim 9, wherein the management server calculates the remaining time of each part, based on the service life and working time of each part, and transfers a guide message for each part replacement to the user terminal, based on the remaining time of each part.

11. A management method of a thermal transfer device, comprising:

receiving state information and failure information from the thermal transfer device; and transferring the received state information and failure information to a user terminal corresponding to the state information and failure information.

12. The management method of claim 11, wherein the management method comprises calculating the remaining time of the thermal transfer device, based on the working time included in the state information and the prestored part service life, and transferring a guide message for part replacement to the user terminal when the remaining time is within the reference time.

13. The management method of claim 11, wherein the management method comprises calculating the remaining time of each part, based on the service life and working time of each part, and transferring a guide message for each part replacement to the user terminal, based on the remaining time of each part.

* * * * *